United States Patent [19]

Seeley et al.

[11] 3,942,680

[45] Mar. 9, 1976

[54] SPRAY PAINT CONTAINER AND ATTACHMENT THEREFOR

[76] Inventors: Larry E. Seeley, 1278 Front St., Binghamton, N.Y. 13905; Edward H. Seeley, Box 72, Great Bend, Pa. 18821

[22] Filed: Apr. 30, 1974

[21] Appl. No.: 465,695

Related U.S. Application Data

[63] Continuation-in-part of Ser. No. 384,280, July 31, 1973, Pat. No. 3,858,810.

[52] U.S. Cl. ..... 220/324; 222/325; 292/358; 239/318; 220/293; 220/303; 220/304

[51] Int. Cl.[2] ..... B65D 45/16

[58] Field of Search ..... 220/293, 251, 303, 304, 220/324; 222/325, 564; 239/318; 292/358

[56] References Cited

UNITED STATES PATENTS

| | | | |
|---|---|---|---|
| 2,051,518 | 8/1936 | Cunningham | 220/325 |
| 2,263,842 | 11/1941 | Gross | 220/324 |
| 2,263,843 | 11/1941 | Gross | 220/324 |
| 3,593,921 | 7/1971 | Bolitic | 220/304 |

*Primary Examiner*—William Price
*Assistant Examiner*—Ro E. Hart
*Attorney, Agent, or Firm*—LeBlanc & Shur

[57] ABSTRACT

The apparatus includes in one form an attachment for a conventional spray paint container comprised of an arcuately shaped receptacle having inner and outer walls and a bottom wall defining an arcuate chamber. An elastic band is secured to opposite ends of the receptacle to releasably secure the latter about the neck of the spray paint container with the inner wall of the receptacle in close fitting relation about the neck. The open upper end of the receptacle lies at an elevation flush with or below the upper edge of the container for collecting paint leaked between the container and its lid and/or from the vent hole in the lid. In one form, the receptacle extends about the neck for less than 180° and slots are provided in the elastic band for receiving the diametrically opposed outwardly projecting pins carried by the neck of the conventional paint container. In another form, the receptacle extends circumferentially a distance greater than 180° and slots are formed in the inner wall of the receptacle for receiving the pins. In a still further form, the receptacle is formed integral with the paint container. A cap is also provided in the vent hole through the lid of the container to deflect paint leaking from or blown out of the container through the vent hole onto the outer face of the lid for collection in the receptacle. In another form, an annular receptacle is carried on the underside of the lid. An aperture is formed through its inner wall and lies in communication through the annular chamber defined thereby with a pair of vent holes opening through the lid thereby isolating such openings and precluding paint leakage through the vent.

24 Claims, 15 Drawing Figures

FIG. 1
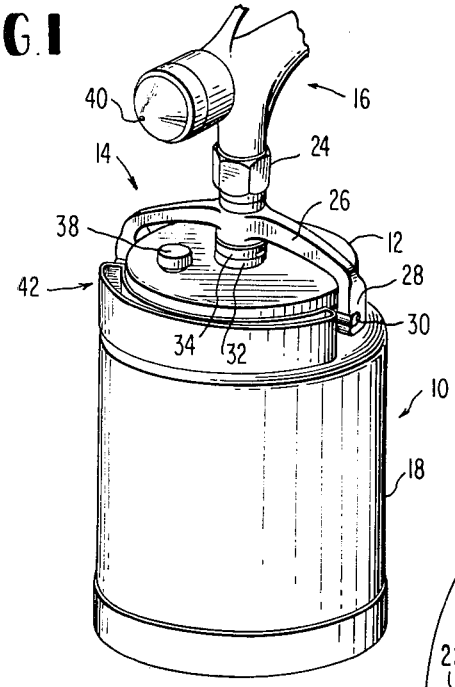
FIG. 2
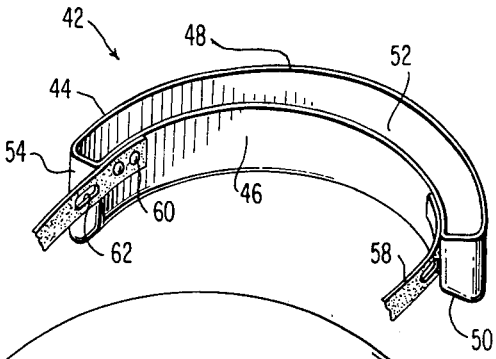
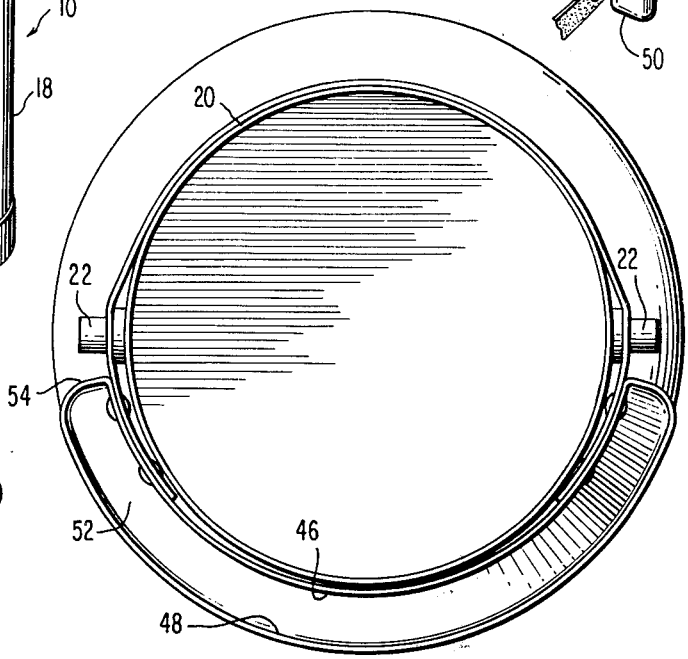
FIG. 3
FIG. 5
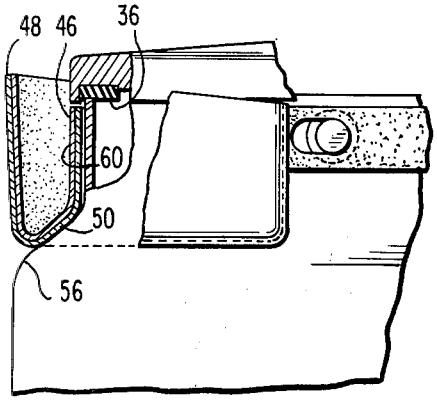
FIG. 4
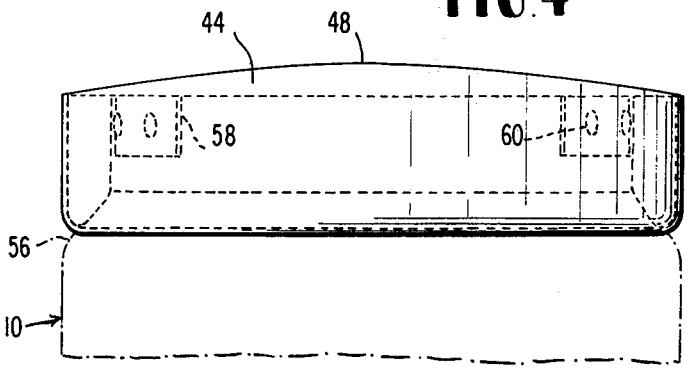

FIG. 6
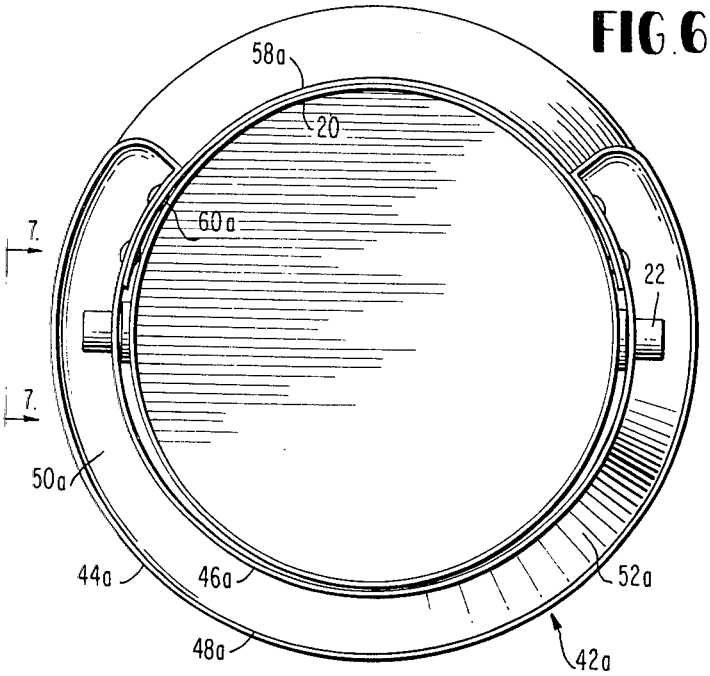
FIG. 7
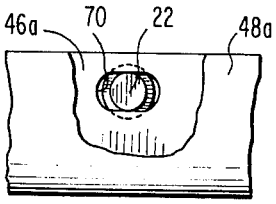
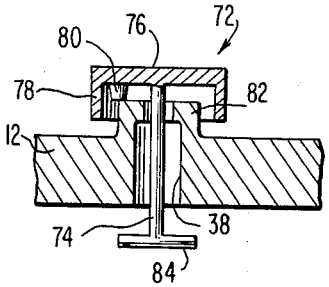
FIG. 8
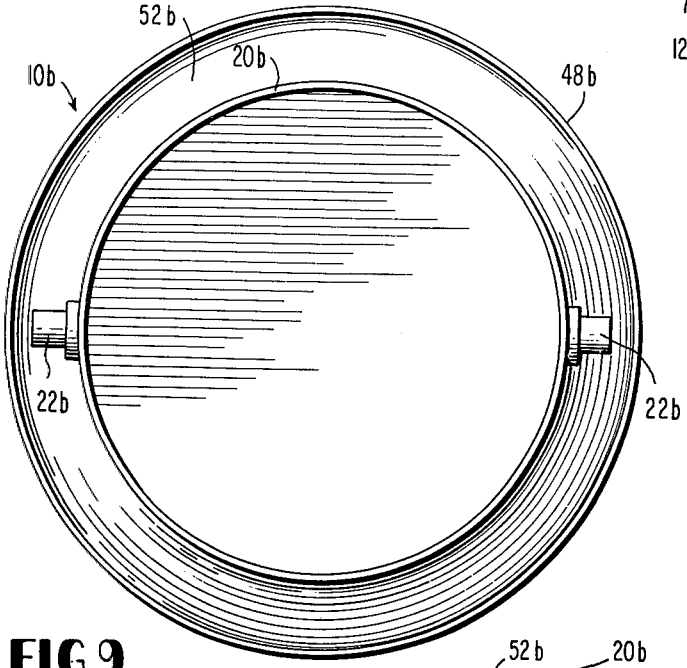
FIG. 9
FIG. 10
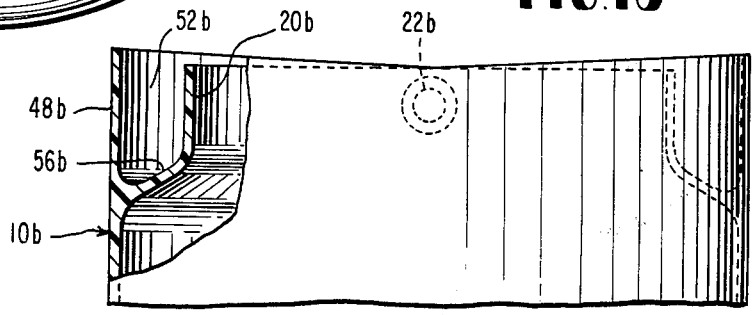

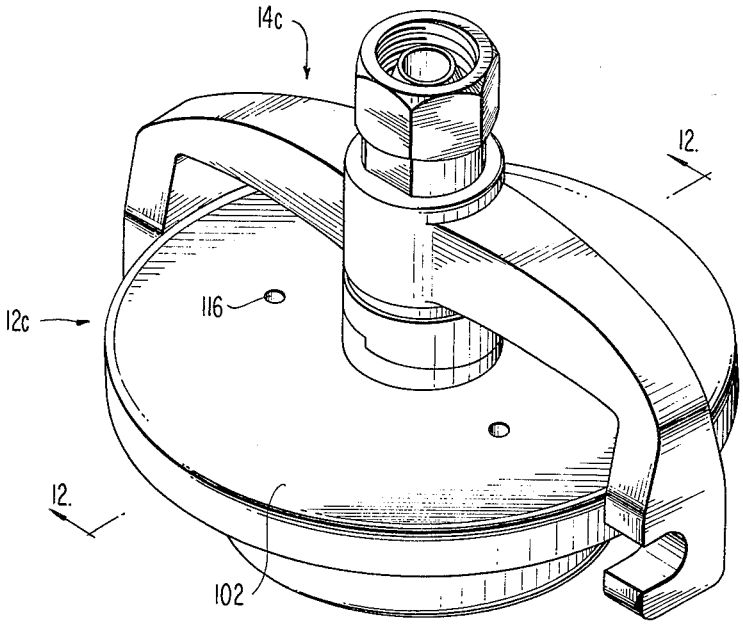
FIG.11
FIG.12
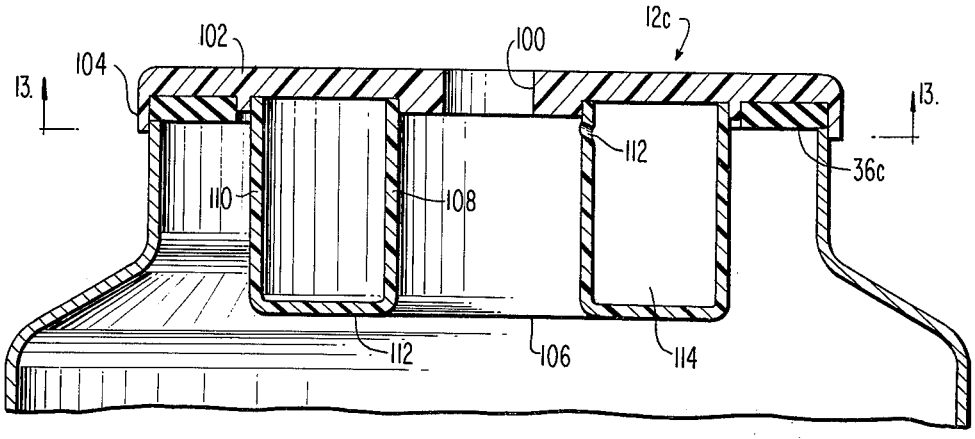
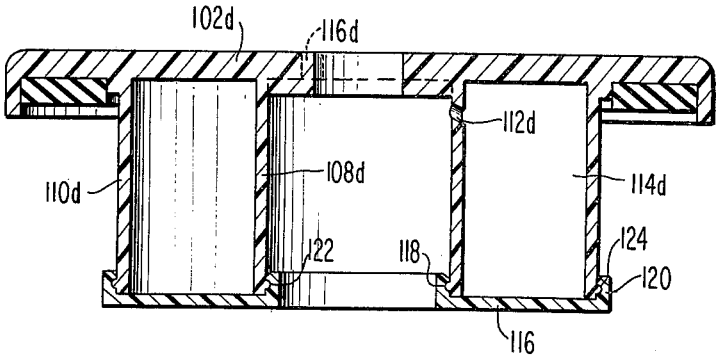
FIG.14

SPRAY PAINT CONTAINER AND ATTACHMENT THEREFOR

This application is a continuation-in-part of application Ser. No. 384,280, filed July 31, 1973 now U.S. Pat. No. 3,858,810 for SPRAY PAINT CONTAINER AND ATTACHMENT THEREFOR.

The present invention relates to paint containers for spray painting and particularly relates to an attachment for use with spray paint cans for collecting paint leaking therefrom, a novel spray paint container per se, a vent cap for deflecting paint leaked or blown through the vent hole in the lid of the container for collection in the receptacle, and a novel lid for spray paint guns for facilitating venting without leakage.

Spray guns for use in painting are generally used in conjunction with standardized paint containers or cans including lids therefor specifically configured for ready connection with the spray guns. Conventional containers or cans utilized with spray guns are each usually comprised of a cylindrical container having a reduced diameter neck with diametrically opposed pins projecting radially outwardly from the neck. The lid most often carries a device for releasably locking the lid to the container as well as a fitting for securing the spray gun to the lid, the fitting including a tubular stem for communicating paint from the container to the nozzle of the spray gun. The locking device includes a pair of arms carried by the stem and which arms project outwardly and downwardly terminating at their lower ends in respective lugs. The lugs have slots for receiving the pins projecting from the neck of the container. A camming device also carried by the stem cooperates with the arms and lid to lock the arms to the pins whereby the lid is releasably secured to the top of the container.

Each of the lids of these conventional paint containers or cans normally carries an annular gasket along its undersurface for sealing engagement with the upper edges of the container neck upon securement of the lid to the container. The lid also has a vent hole for equalizing the pressure within and without the paint container while spray painting. When the spray gun is secured to the stem and a source of air under pressure is attached to the gun, paint is siphoned from the container to the nozzle of the gun and sprayed onto the surface to be painted.

Spray painting utilizing the conventional container lid and spray gun attachment as described previously is, however, not without problems. One very significant problem is leakage of paint from between the container and the lid. This oftentimes occurs due to improper sealing between the gasket carried by the lid and the upper edges of the container neck and is usually caused by worn gaskets. Even with new gaskets, however, improper sealing does occur before the gasket seals properly about the container neck. Accordingly, the paint leaked from between the lid and container adheres to the outside of the paint container and undesirably very often drips onto the work surface and/or adjacent surfaces.

Another source of paint leakage and consequent leakage of paint onto the work and/or adjacent surfaces is through the vent hole in the lid. If the container is canted sufficiently during use, a quantity of the paint will flow out of the vent hole onto the lid and probably onto the work and/or adjacent surfaces. Also, the vent very often becomes clogged with paint which renders the spray gun inoperative or ineffective. Most painters, rather than cleaning the vent hole, will, while spray painting, cover the spray gun nozzle whereby the paint blocking the vent hole is blown out of the hole. Obviously, clearing the vent hole in this manner permits paint to be sprayed outwardly through the vent hole and onto the work and/or adjacent surfaces.

The present invention, in one form hereof, provides an attachment for a standard paint container utilized in spray painting and which attachment serves to collect the paint leaked from between the container and its lid as well as paint leaked onto the outer surface of the lid, for example through the vent hole. To accomplish this, the present invention provides an attachment comprised of an arcuately shaped receptacle having inner and outer walls and a bottom wall for securement about the neck of the paint container. A strap, preferably formed of elastic material, is connected at opposite ends to the respective opposite ends of the receptacle whereby the receptacle and strap encompass the neck of the standard paint container previously described with the inner wall of the receptacle in close fitting engagement about the container neck. Paint leaking through an ineffective portion of the seal between the gasket carried by the lid and the container neck can thus be collected in the receptacle. In one form, the receptacle extends about the container neck a circumferential distance less than 180°. Openings are provided in the opposite ends of the strap for receiving the diametrically opposed, radially outwardly projecting pins carried by the container neck. In another form, the receptacle extends about the neck of the container a circumferential distance greater than 180°. Slots are provided in the inner wall of the receptacle for receiving the pins on the container neck. In both cases, the strap is preferably formed of elastic material and draws the receptacle taut about the neck of the container. It will be appreciated that full encirclement of the container neck is not usually necessary if the spray gun nozzle and receptacle lie on like sides of the container since the container will most likely be canted to that same side.

In another form hereof, a novel paint container of this type is provided and which container has a receptacle formed integral therewith. That is, an outer wall is provided, spaced from the container neck. The outer wall is provided as an integral part of the container and defines with the reduced diameter container neck an annular receptacle thereabout. In this embodiment, the container can be formed of plastic material with its outer wall integrally molded therewith.

A further feature of the present invention is the provision of a vent cap for the conventional vent hole formed in the lids for spray paint containers of this type. The cap includes a stem receivable through the vent hole and carrying an external head having a depending skirt. A retaining element is carried by the inner end of the stem. The head is normally spaced from the margins of the vent hole whereby the vent is normally open. Should the vent become clogged with paint and the painter close the nozzle of the spray gun whereby the clogging paint is blown through the vent hole, the blown paint is deflected by the head and depending skirt onto the outer surface of the lid for flow into the receptacle. The vent cap therefore prevents paint from being inadvertently blown onto the work and/or adjacent surfaces.

A still further embodiment of the present invention provides a spray paint container having segregated or isolated vent passages for preventing outflow of paint from the container through its vent. In one form of this embodiment, an annular receptacle is carried by the lid along its underface. A pair of vent holes through the lid open into the annular chamber defined by the receptacle. An aperture is formed through the inner wall of the receptacle and a vent passage to the paint container is thus provided through the vent holes in the lid, the annular chamber, and the aperture. The vent holes lie along a chord line on the forward part of the lid while the aperture is formed adjacent the underface of the lid at a location equally circumferentially spaced from the vent holes. In this manner, the vent holes are isolated from the aperture thereby precluding paint leakage through the vent. In another form hereof, the bottom wall of the annular receptacle is removable to facilitate cleaning of the vent chamber. In still another form, such annular receptacle is provided in the top of the can with the lid being provided similar vent holes in communication with the annular chamber when the lid is sealed to the container and to the upper margins of the receptacle. In all these forms, venting isolation is achieved. Also, should the aperture in the receptacle become clogged, the painter can simply cover the spray gun nozzle to blow air through the vent passage to clear the clogged aperture without the danger of blowing paint from the gun onto the work or adjacent surfaces.

Accordingly, it is a primary object of the present invention to provide a novel and improved spray gun attachment for collecting paint leaked from a spray paint container.

It is another object of the present invention to provide a novel and improved spray gun attachment specifically configured for releasable securement to standard spray paint containers for collecting paint leaked therefrom.

It is another object of the present invention to provide a novel and improved attachment for spray paint containers which prevents leakage of paint from the container onto the work and/or adjacent surfaces.

It is a further object of the present invention to provide an attachment having the foregoing characteristics which can be readily and easily constructed and formed of readily available inexpensive materials.

It is a still further object of the present invention to provide in combination with the foregoing a vent cap for the vent hole in the lid of the spray container for deflecting paint blown and/or leaked through the vent hole onto the outer surface of the lid for collection in the attachment.

It is a still further object of the present invention to provide a novel and improved spray paint container having a receptacle formed integrally therewith for collecting paint leaked from the spray paint container.

It is a related object of the present invention to provide a novel and improved spray paint container having a venting passage which opens externally of the container and internally thereof at isolated locations to preclude paint spillage and paint from blowing through the vent passage.

These and further objects and advantages of the present invention will become more apparent upon reference to the following specification, appended claims and drawings wherein:

FIG. 1 is a perspective view of a paint spray container with a spray gun secured thereto and illustrating a novel and improved attachment for collecting paint leaked therefrom constructed in accordance with the present invention;

FIG. 2 is an enlarged perspective view of one form of attachment hereof;

FIG. 3 is a plan view of the spray paint container with the attachment of FIG. 2 secured thereto;

FIG. 4 is an enlarged front elevational view thereof;

FIG. 5 is an enlarged fragmentary side elevational view thereof with parts broken out and in cross section;

FIG. 6 is a view similar to FIG. 3 and illustrates a further form of attachment in accordance with the present invention;

FIG. 7 is an enlarged fragmentary view with parts broken out for ease of illustration and taken generally about on line 7—7 in FIG. 6;

FIG. 8 is an enlarged fragmentary cross-sectional view of the vent hole in a paint container lid with a vent cap therein constructed in accordance with the present invention;

FIG. 9 is a plan view of a still further form of spray paint container constructed in accordance with the present invention;

FIG. 10 is a fragmentary enlarged side elevational view thereof with parts broken out and in cross section;

FIG. 11 is an enlarged perspective view of a further embodiment of the present invention and illustrating a modified spray paint container lid;

FIG. 12 is an enlarged cross-sectional view thereof taken generally about on line 12—12 in FIG. 11;

FIG. 14 is a view similar to FIG. 12 and illustrates a further form of lid for the spray paint container hereof.

Figure 13:
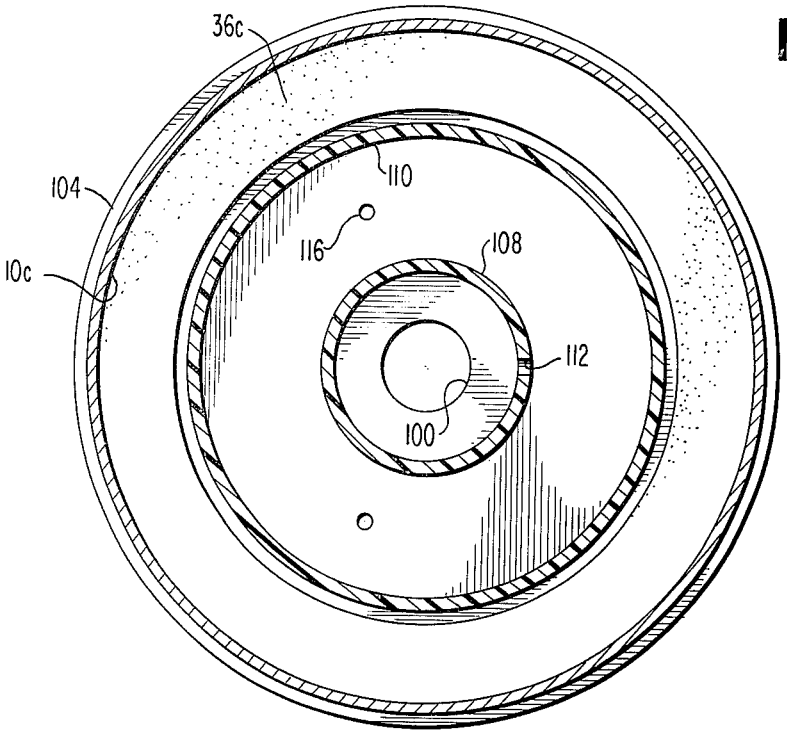
FIG. 13 is an enlarged cross-sectional view thereof taken generally about on line 13—13 in FIG. 12.

Referring now to the drawings, particularly to FIG. 1, there is illustrated a conventional spray paint container or can generally designated 10 having a lid 12, a device generally designated 14 for securing lid 12 to container 10 and a spray gun generally designated 16. Container 10 includes a cylindrical body 18, a closed lower end, and a reduced diameter neck 20 defining an opening through the upper end of the container. In spray paint containers of this type, a pair of pins 22 project radially outwardly from diametrically opposite sides of neck 20 for cooperation with device 14 for securing lid 12 to container 10. A stem including a siphon tube, not shown, extends axially through lid 12 and carries a nut 24 loosely coupled about its upper end for securing the spray gun 16 to the lid 12 and hence to container 10. Secured about the stem for limited axial sliding movement is a pair of radially extending arms 26 terminating at their opposed ends in downwardly projecting lugs 28 having circumferentially opening slots 30 for receiving the pins 22 on container 10. A disc-like fixed cam 32 is carried by lid 12 about the stem and below arms 26. A similar disc-like movable cam 34 is disposed about the stem between the fixed cam 32 and arms 26. An arm, not shown, projects from movable cam 34 for rotating cam 34. Rotation of cam 34 causes arms 26 to move in an axial direction.

Accordingly, in order to secure lid 12 to container 10, the lid is located on top of the container neck 20 with the annular gasket 36 (FIG. 5) carried along its underside bearing against the upper edges of neck 20. The lid 12 is rotatably positioned such that the pins 22 are received within the slots 30 of arms 26. The movable cam 34 is thereafter rotated to displace the arms 26 axially outwardly whereby the container and lid are clamped one to the other with the gasket 36 forming a seal along the upper edge of the container neck. It will be appreciated that with the lid secured to the container in this manner, the siphon tube, not shown, extends to adjacent the bottom of the container. The lid 12 also carries a vent hole 38.

The foregoing described container and lid construction is conventional. When the spray gun 16 is coupled to the lid 12 by nut 24 either before or after lid 12 is secured to container 10 and an air source is coupled to the spray gun, the air causes paint within the container to flow upwardly through the siphon tube, not shown, through the stem and into gun 16 for spraying through the gun nozzle 40. The vent hole 38 in lid 12 is necessary to permit outflow of paint from container 10.

As noted previously, the seal between gasket 36 of lid 12 and neck 20 of container 10 often wears or is inadequate in the first instance whereby paint leakage between the lid and container occurs. Also, paint leaks through the vent hole 38 when the container is canted or when the painter attempts to clean the vent hole by blowing paint through it by covering nozzle 40. This leaked paint very quickly covers the paint container and very often gets onto the work and/or adjacent surfaces. In one form of the present invention, there is provided an attachment generally designated 42 for collecting the paint leaking from the paint container from either or both of these sources of paint leaks whereby paint is prevented from dripping from the container. Referring particularly to FIG. 2, the attachment 42 comprises an arcuately shaped receptacle 44 having inner and outer walls 46 and 48 respectively, and a bottom wall 50 interconnecting the lower edges of inner and outer walls 46 and 48 to define an arcuately extending chamber 52. End walls 54 are also provided whereby receptacle 44 extends a discrete distance in a circumferential direction. In the form hereof illustrated in FIGS. 1–5, the receptacle 44 extends a circumferential distance slightly less than 180° and is configured such that the inner wall 46 obtains substantially the same curvature as the neck 20 of container 10.

Receptacle 44 has a depth substantially the height of the neck 20 of container 10. The bottom wall 50 of receptacle 44 slopes outwardly as illustrated in FIG. 5 to conform to and bear against a shoulder 56 which forms the transition between neck 20 and the body container 10. Receptacle 44 may be formed of any type of material and in a preferred embodiment is formed of plastic material whereby the receptacle is to a limited extent flexible in a circumferential direction for achieving a close fit about the neck 20 and for other reasons which will become clear from the ensuing description.

A strap 58 has opposite end portions which are secured to the respective opposite ends of receptacle 44. Preferably, strap 58 is formed of an elastic material and its end portions may be suitably riveted as by one or more rivets 60 along and to the inner wall 46 of receptacle 44. In the form illustrated in FIGS. 1–5, the strap is provided with a slot 62 in each of its opposite end portions for receiving the pins 22 when the receptacle is applied about the neck of the paint container 10.

In order to utilize the paint container and receptacle described above, receptacle 44 is located about the container neck 20 on one side of pins 22. Particularly, the elastic strap 58 is disposed about neck 20 on the opposite side thereof from receptacle 44 with the pins 22 being received in the slots 62. The elastic strap thus draws the receptacle 44 in close fitting relation about the neck 20 of the container 10 whereby the inner wall 46 of the receptacle bears directly against neck 20. It will be appreciated that the strap 58 need not extend completely about neck 20 but may extend sufficiently only for attachment to pins 22. However, the illustrated embodiment is preferred in view of the greater elasticity obtained by using a longer strap. As illustrated in FIG. 5, it will be seen that the upper edge of inner wall 46 lies flush with or slightly below the upper edge of neck 20. The upper edge of the outer wall 48 extends above the upper edge of the inner wall 46 since the container is normally canted in this direction in use thereby providing a chamber 52 of increased capacity. Once the receptacle is applied about neck 20, lid 12 may be secured to the container in the manner previously described. From a review of FIGS. 4 and 5, it will be appreciated that any paint leaking from the container past the annular gasket 36 carried by lid 12 would thus leak into the chamber 52 defined by receptacle 44. It will be appreciated that in applying lid 12 to container 10, the nozzle 40 of the spray gun is located on the same side of can 10 as attachment 42. Since, most often, spray painting is accomplished with the nozzle pointed downwardly, i.e., the container being in a canted position, it will be appreciated that any leakage past the gasket 36 will flow into the receptacle 42.

In a preferred form hereof, a liner 60 is provided for lining the inner wall surfaces of receptacle 44. Preferably, this can be in the form of a replacable or reusable absorbent or nonabsorbent paper shaped and configured to lie within the chamber 52 and substantially coextensively with the walls defining chamber 52.

Referring now to the embodiment hereof illustrated in FIGS. 6 and 7, attachment **42*a* is similar to the attachment illustrated in the previous embodiment but has a circumferential extent exceeding 180° as will be appreciated from the following description. The attachment 42*a* includes a similar receptacle 44*a* as previously described and has inner and outer walls 46*a* and 48*a* and a bottom wall 50*a*. Receptacle 44*a*, however, extends a circumferential distance approximately 250° about the neck 20 of the container. As in the previous embodiment, a strap 58*a* preferably formed of elastic material is provided and has opposite ends suitably secured to the opposite ends of the receptacle, for example by one or more rivets 60*a*. In this form, however, a pair of slots 70 are formed through the inner wall 46*a* of receptacle 41*a* at diametrically opposed positions therealong. The slots are elongated in a circumferential direction as illustrated in FIG. 7. In applying the receptacle to the paint container 10, attachment 42*a* is flexed such that the pins 22 are receivable within the slots 70. The elastic strap 58*a* is then disposed about the backside of neck 20 whereby receptacle 44*a* is drawn taut about neck 20 such that its inner wall 46*a* lies in close fitting relation therewith. It will be appreciated that pins 22 remain free for connection with the arms 26 of device 14 whereby lid 12 is secured to container 10. That is, lugs 28 extend to a limited extent within the chamber 52*a* of receptacle 44*a*** when in use.

Referring to FIG. 8, it will be recalled that a painter very often blocks the nozzle 40 on the spray gun in order to unclog the vent hole by blowing paint through it. There is thus the danger of blowing the paint onto the work and/or adjacent surfaces. To preclude this, the present invention also provides a vent cap generally designated 72 comprised of a stem 74 having a head 76. Head 76 is provided with a depending annular skirt 78 and a downwardly projecting lug 80 along its underside for engagement with a boss 82 formed on lid 12 and surrounding vent hole 38, whereby head 76 is spaced from the vent hole. The vent hole is thus maintained in a normally open condition. A retainer pin 84, is provided on the lower end of stem 74 preferably by threaded engagement therewith to prevent loss of the vent cap 72. Consequently, any paint blown through the vent hole 38 is deflected against the underside of head 76 and against skirt 78 for disposition along the outer surface of lid 12. Since the paint container is usually inclined or canted in a forward direction during use, this paint leakage eventually flows into chamber 52*a* of receptacle 42*a* or the receptacle illustrated in FIGS. 1–5.

Referring now to FIGS. 9 and 10, the present invention hereof also includes a paint container 10*b* specifically configured to provide a chamber 52*b* about the neck 20*b* of the container. Particularly, a wall 48*b* is formed integrally with container 10*b* and is spaced radially outwardly of the wall forming the neck 20*b* of container 10*b*. The annular shoulder 56*b* interconnecting neck 20*b* and the body of the container 10*b* also forms the lower wall for chamber 52*b*. It will thus be appreciated that the chamber 52*b* comprises a full annulus surrounding the opening of the paint container through neck 20*b*. The upper edge of the outer wall 48*b* tapers upwardly from the diameter of the container containing the pins 22*b* and peaks at diametrically opposed sides of the container. In this form, the container is preferably formed of a plastic material and it will be appreciated that the pins likewise can be integrally molded therewith or formed of metal and secured thereto whereby the lid and spray gun can be attached in a similar manner as previously described. Thus, in this form, paint leaking past the gasket on the underside of the lid and/or through the vent hole flows into chamber 52*b*.

In the embodiment hereof illustrated in FIGS. 11–13, there is provided a spray paint container lid generally designated 12*c*. Lid 12*c* carries a locking device 14*c* identical to the locking device 14 described in connection with FIG. 1. The siphon tube, not shown, extends through a central aperture 100 formed in lid 12*c* and through the locking device 14*c*. In this form, the lid comprises a circular disc-like body or cover 102, preferably formed of a plastic material (although it will be appreciated that other material such as metal may also be utilized), having a depending marginal flange 104 and an annular gasket 36*c* extending about cover 102 inwardly of flange 104 and along its underface. A receptacle 106 depends from the underface of cover 102. Particularly, receptacle 106 comprises an annulus having inner and outer walls 108 and 110 respectively and a bottom wall 112. The central opening defined by the inner wall 108 enables the siphon tube to extend from the spray gun through the opening 100 in cover 102 into the paint container 10*c*.

Receptacle 106 is also preferably formed of plastic and is suitably secured to the underface of cover 102. For example, receptacle 106 may be spun welded to the underside of cover 102 whereby it becomes essentially integral therewith. It will be appreciated however, that the receptacle can be otherwise attached to cover 102. Receptacle 106 is provided with an aperture 112 formed through inner wall 108 directly adjacent the underface of cover 102. Particularly aperture 112 slopes upwardly from annular chamber 114 defined by the inner and outer walls 108 and 110 respectively and is closely spaced, i.e., about 1/16th inch, from the underface of cover 102 to substantially eliminate any paint flow during use into annular chamber 114 through aperture 112.

A pair of vent holes 116 are formed through cover 102 at radial positions thereabout to lie in communication with annular chamber 114. Vent holes 116 are spaced forwardly of a diameter of cover 102 extending through the arms of device 14 and toward the front part of the paint can, i.e., on the nozzle side of the spray gun when in use. Particularly, vent holes 116 lie along a chord of the circle defined by cover 102 which chord parallels the above-noted diameter while aperture 112 is equally circumferentially spaced from the respective vent holes 116. A single vent hole or more than two may be utilized although two are preferred. Thus, a vent passage is provided through vent holes 116, annular chamber 114, and aperture 112 into the can whereby paint spraying can be accomplished.

From a review of FIG. 13, it will be appreciated that the vent holes 116 are isolated from and remotely positioned relative to the aperture 112. Thus, when the spray paint container is utilized, paint is effectively precluded from flowing or being blown out of vent holes 116 onto the cover and onto the work or adjacent surfaces. Moreover, by locating the aperture 112 through inner wall 108 and directly adjacent the undersurface of cover 102 and particularly by inclining its opening, the probability of paint entering chamber 114 is minimized. Consequently, very little paint, if any, enters annular chamber 114 through aperture 112 and any paint that does enter chamber 114 is located remotely from vent holes 116 thus effectively preventing any paint leakage through the vent passage.

Referring now to FIG. 14, there is illustrated a modified form of the cover illustrated in FIGS. 11 – 13. In this form, the cover 102*d* has radially spaced depending inner and outer walls 108*d* and 110*d* forming an annular chamber 114*d* therebetween. The walls 108*d* and 110*d* are formed integrally with the cover 102*d*, it being appreciated that these walls are preferably formed of a plastic material and formed integrally with cover 102*d*. Vent holes 116*d* are provided through cover 102*d* similarly as in the cover 102 illustrated in FIG. 11. An aperture 112*d* is also provided through the inner wall 108*d* adjacent the underface of cover 102*d*, aperture 112*d* being upwardly inwardly inclined from chamber 114*d*. The spacing of the vent holes 116*d* relative to aperture 112*d* are identical to the spacing of the corresponding openings as described above in connection with FIGS. 11 – 13.

To close the bottom of annular chamber 114*d*, there is provided an annulus 116 having upstanding inner and outer annular flanges 118 and 120 respectively. The inner margin of wall 108*d* is provided with a radially inwardly projecting bead 122, while the outer margin of outer wall 110*d* is provided with a radially outwardly projecting bead 124, beads 122 and 124 being located adjacent the lower ends of walls 108*d* and 110*d* respectively. Flanges 118 and 120 of annular member 116 are provided with corresponding annular recesses about their respective outer and inner faces whereby the annular member 116 can be releasably snapped onto walls 108*d* and 110*d*. Annulus 116 thus forms a releasable closure for annular chamber 114*d*. In this manner, any paint entering chamber 114*d* can be readily removed by removing member 116 from the walls 108*d* and 110*d* and cleaning the surface of member 116 and/or the inner surfaces of the walls 108*d* and 110*d*. As in the previous embodiment, the vent passage is provided by openings 116, chamber 114*d*, and aperture 112*d*.

Figure 15:
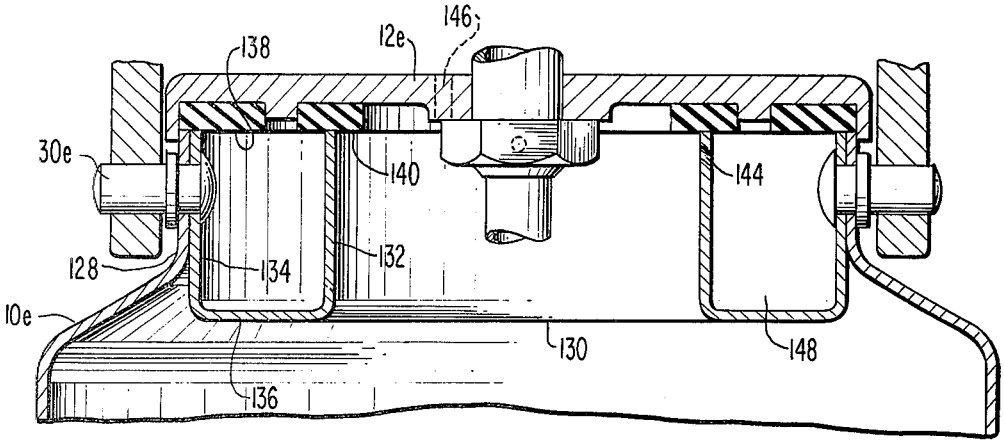
FIG. 15 is an enlarged fragmentary cross-sectional view of a still further form of spray paint container hereof.

Referring now to the embodiment hereof illustrated in FIG. 15, there is provided a spray paint container 10*e* having a conventionally configured neck 128. The lid 12*e* is similar in all respects to the lid illustrated in FIG. 1 hereof with the exceptions noted below and carries a locking device similar to the locking device 14 illustrated in FIG. 14 for releasably securing the lid 12*e* to container 10*e*. In this form, container 10*e* is provided with an annular receptacle 130 within the container neck 128. The annular receptacle is comprised of inner and outer walls 132 and 134 respectively and which walls are interconnected by a lower annular wall 136. Receptacle 130 is secured in the neck 128 of container 10*e* by the pins 30*e* which extend through the outer wall 134 of receptacle 130 and through openings formed in the neck 128 of container 10*e*. As will be recalled, these pins 30*e* form part of the connection for securing the lid to the can as described above.

A pair of annular gaskets 138 and 140 are carried along the underside of lid 12*e*, gaskets 138 and 140 being radially spaced one from the other. As illustrated in FIG. 15, outer gasket 138, when lid 12*e* is applied to container 10*e*, seals against the upper margin of container neck 128 and also the upper margin of outer wall 134 of annular receptacle 130. Inner gasket 140, when the lid 12*e* is secured to container 10*e*, seals against the upper margin of inner wall 132. Similarly as in FIGS. 11–13 and FIG. 14, the annular receptacle 130 in FIG. 15 is provided with an aperture 144 formed at an angle through inner wall 132 adjacent the underface of cover 12*e*. Also, a pair of vent openings 146 are provided through cover 12*e* in communication with annular chamber 148 defined by walls 132, 134 and 136. The vent holes 146 and aperture 144 are circumferentially spaced and radially positioned relative to one another similarly as described above in connection with the embodiments of FIGS. 11 – 13 and 14. Consequently, the vent passage is provided through cover 12*e* by way of vent holes 146, annular chamber 148 and aperture 144. As in the previous embodiments, the isolation of aperture 144 from the vent openings 146 prevents paint spillage and/or paint from blowing through the vent from the spray paint container. In this embodiment, any paint in annular chamber 148 can be readily removed simply by removing cover 12*e* and cleaning receptacle 130.

In the embodiments illustrated in FIGS. 11–15 hereof, each annular receptacle preferably has a depth of about 1 inch deep with its inner and outer walls spaced one from the other approximately ⅝th inch. The diameter of the vent openings and aperture in each case is preferably ⅛th inch. The location of the aperture in the inner wall of the receptacles is preferably 1/16th inch from the underface of the lid.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A closure for a spray paint container comprising a cover adapted to carry a spray paint gun, means carried by said cover and cooperable with the container for releasably securing said cover to the container, means carried by said cover providing for communication between the interior of the container when said cover is releasably secured thereto and the exterior of the container including a housing having walls at least in part defining a chamber, said cover having an aperture therethrough in communication with said chamber, one of the walls of said housing having an aperture therethrough providing communication between said chamber and the interior of the container when said cover is secured thereto, said apertures being spaced one from the other, and means carried by said cover and cooperable with the container for sealing the cover to the container when said cover is secured thereto whereby said apertures provide a vent passage through said cover and housing into the container.

2. Apparatus according to claim 1 wherein said cover is generally circular in plan and said apertures are circumferentially spaced one from the other about said cover.

3. Apparatus according to claim 1 wherein the walls of said housing include spaced sidewalls extending in generally circular configurations about said cover and a lower wall generally annular in shape interconnecting the lower margins of said sidewalls whereby said walls define a generally annular chamber, said apertures lying in circumferentially spaced positions relative to one another about said cover.

4. Apparatus according to claim 3 including means for releasably securing said lower wall to said sidewalls.

5. Apparatus according to claim 1 wherein said cover is generally circular in plan, said housing defining a substantially annular shaped chamber.

6. Apparatus according to claim 5 wherein said apertures are circumferentially spaced one from the other about said cover, said housing and said chamber lying along the underside of said cover.

7. Apparatus according to claim 6 wherein said securing means includes a pair of arms extending in radially opposite directions from a central portion of said cover, the aperture through said cover lying alongside the diameter defined by the arms with the aperture through said one wall being located on the opposite side of said diameter.

8. Apparatus according to claim 6 in combination with said container, said container having a generally circular neck carrying a pair of radially outwardly oppositely directed pins on substantially a diameter of said container neck, said securing means including a pair of arms extending in radially opposite directions from the central portion of said cover, and means carried by the distal ends of said arms for engagement with said pins to releasably secure said cover to said container.

9. Apparatus according to claim 8 wherein the aperture through said cover lies on one side of said diameter with the aperture through said one wall being located on the opposite side of said diameter.

10. Apparatus according to claim 9 wherein said cover has a pair of apertures therethrough constituting vent holses in communication with said chamber, said vent holes lying substantially on one side of said diameter along a chord line generally parallel to said diameter.

11. Apparatus according to claim 8 wherein the walls of said housing include spaced sidewalls extending in generally circular configurations about said cover and a lower wall generally annular in shape interconnecting the lower margins of said sidewalls whereby said walls define said generally annular chamber.

12. Apparatus according to claim 11 wherein the aperture through said one wall opens through the inner wall of said housing directly adjacent the underside of said cover.

13. Apparatus according to claim 12 wherein said cover has a pair of apertures constituting vent holes in communication with said chamber, said vent holes lying substantially on one side of said diameter with the aperture through said one wall being located on the opposite side of said diameter.

14. Apparatus according to claim 11 including means for releasably securing said lower wall to said side walls.

15. Apparatus according to claim 1 including means carried by said cover providing for access to the interior of said housing.

16. Apparatus for spray painting comprising a container having a generally circular neck, an annular housing including spaced sidewalls extending in generally circular configurations about said housing and a lower wall interconnecting said sidewalls to define an annular chamber, means for securing said housing in said container neck, a cover for said container, means for releasably securing said cover to said container, means cooperable between said cover and said container when said cover is secured thereto for sealing said cover to said container neck, means carried by said cover and engageable with the upper edges of said sidewall to substantially seal said chamber from said container, and means for venting said container when said cover is secured thereto including an aperture through said cover in communication with said annular chamber, one of said sidewalls having an aperture therethrough providing communication between said chamber and the interior of said container whereby said apertures are isolated one from the other and provide a vent passage through said chamber for venting said container.

17. Apparatus according to claim 16 wherein said apertures are circumferentially spaced one from the other about said cover.

18. Apparatus according to claim 16 wherein the aperture through the one housing wall extends through the inner sidewall and directly adjacent the underside of said cover when secured to said container.

19. Apparatus according to claim 17 wherein said securing means includes a pair of arms extending in radially opposite directions from the central portion of said cover, the aperture through said cover lying on one side of the diameter defined by said arms with the aperture through said one wall being located on the opposite side of said diameter.

20. A closure for a spray paint container comprising a cover adapted to carry a spray paint gun, means carried by said cover and cooperable with the container for releasably securing said cover to the container, means carried by said cover providing for communication between the interior of the container when said cover is releasably secured thereto and the exterior of the container including a housing having walls at least in part defining a chamber, said cover having an aperture therethrough in communication with said chamber, one of the walls of said housing having an aperture therethrough providing communication between said chamber and the interior of the container when said cover is secured thereto, means cooperable with the container and said cover about its margin for sealing the cover to the container when said cover is secured thereto whereby said apertures in said chamber provide a vent passage through said cover into the container, and means carried by said cover providing for access to the interior of said housing.

21. Apparatus according to claim 20 wherein said housing and said chamber lie along the underside of said cover and within the container when said cover is releasably secured thereto, the walls of said housing including spaced sidewalls extending in generally circular configurations about said cover and a lower wall generally annular in shape interconnecting the lower margins of said sidewalls whereby said walls define a generally annular chamber.

22. Apparatus according to claim 20 in combination with said container, said container having a generally circular neck carrying a pair of radially outwardly oppositely directed pins on substantially a diameter of said container neck, said securing means including a pair of arms extending in radially opposite directions from the central portion of said cover, means carried by the distal ends of said arms for engagement with said pins to releasably secure said cover to said container, said sealing means being carried by said cover for sealing the same about the circular neck of said container.

23. Apparatus according to claim 21 wherein said access means includes means for releasably securing said lower wall to said side walls.

24. Apparatus according to claim 20 wherein said housing and said chamber lie along the underside of said cover and within the container when said cover is releasably secured thereto, the walls of said housing including spaced sidewalls extending in generally circular configurations about said cover and a lower wall generally annular in shape interconnecting the lower margins of said sidewalls whereby said walls define a generally annular chamber, said apparatus being in combination with said container, said container having a generally circular neck carrying a pair of radially outwardly oppositely directed pins on substantially a diameter of said container neck, said securing means including a pair of arms extending in radially opposite directions from the central portion of said cover, means carried by the distal ends of said arms for engagement with said pins to releasably secure said cover to said container, said sealing means being carried by said cover for sealing the same about the circular neck of said container.

* * * * *

UNITED STATES PATENT AND TRADEMARK OFFICE

CERTIFICATE OF CORRECTION

PATENT NO. : 3,942,680

DATED : March 9, 1976

INVENTOR(S) : Larry E. Seeley and Edward H. Seeley

It is certified that error appears in the above-identified patent and that said Letters Patent are hereby corrected as shown below:

Col. 8, line 53, "upwardly inwardly" should read --upwardly and inwardly--.

Signed and Sealed this

Fifth Day of October 1976

[SEAL]

*Attest:*

RUTH C. MASON
*Attesting Officer*

C. MARSHALL DANN
*Commissioner of Patents and Trademarks*

REEXAMINATION CERTIFICATE (1258th)

United States Patent [19] [11] B1 3,942,680

Seeley et al. [45] Certificate Issued Apr. 24, 1990

[54] SPRAY PAINT CONTAINER AND ATTACHMENT THEREFOR

[76] Inventors: Larry E. Seeley, 1278 Front St., Binghamton, N.Y. 13905; Edward H. Seeley, Box 72, Great Bend, Pa. 18821

Reexamination Reqs:st:

No. 90/001,362, Oct. 28, 1987
No. 90/001,400, Dec. 21, 1987

Reexamination Certificate for:

| | |
|---|---|
| Patent No.: | **3,942,680** |
| Issued: | **Mar. 9, 1976** |
| Appl. No.: | **465,695** |
| Filed: | **Apr. 30, 1974** |

Certificate of Correction issued Oct. 5, 1976.

Related U.S. Application Data

[63] Continuation-in-part of Ser. No. 384,280, Jul. 31, 1973, Pat. No. 3,858,810.

[51] Int. Cl.[5] ..... B65D 45/16

[52] U.S. Cl. ..... 220/324; 220/293; 220/303; 220/334; 222/325; 239/318; 292/259 R; 292/358

[58] Field of Search ..... 220/202, 204, 205, 367, 220/369, 371, 373, 374; 292/478, 630; 239/124, 333, 371, 378, 526

[56] References Cited

U.S. PATENT DOCUMENTS

| | | | |
|---|---|---|---|
| 1,187,371 | 6/1916 | Daniels | 239/371 |
| 1,482,534 | 2/1924 | Woodbridge | 220/374 |
| 1,996,292 | 4/1935 | Harding et al. . | |
| 2,582,566 | 1/1952 | Schwimmer et al. | 215/309 |
| 2,608,841 | 9/1952 | Rice | 215/309 |
| 2,670,882 | 3/1954 | Best | 222/464 |
| 2,899,098 | 8/1959 | Gits | 220/410 |
| 3,240,398 | 3/1966 | Dalton, Jr. . | |
| 3,401,842 | 9/1968 | Morrison . | |
| 3,714,967 | 2/1973 | Zupan et al. | 222/464 |
| 3,990,609 | 11/1976 | Grant | 222/111 |
| 4,511,198 | 4/1891 | Adams | 220/373 |

FOREIGN PATENT DOCUMENTS

| | | | |
|---|---|---|---|
| 110465 | 5/1940 | Australia | 239/348 |
| 454053 | 9/1936 | United Kingdom | 215/309 |
| 520445 | 4/1940 | United Kingdom | 215/309 |
| 977809 | 12/1964 | United Kingdom . | |

*Primary Examiner*—Stephen Marcus

[57] ABSTRACT

The apparatus includes in one form an attachment for a conventional spray paint container comprised of an arcuately shaped receptacle having inner and outer walls and a bottom wall defining an arcuate chamber. An elastic band is secured to opposite ends of the receptacle to releasably secure the latter about the neck of the spray paint container with the inner wall of the receptacle in close fitting relation about the neck. The open upper end of the receptacle lies at an elevation flush with or below the upper edge of the container for collecting paint leaked between the container and its lid and/or from the vent hole in the lid. In one form, the receptacle extends about the neck for less than 180° and slots are provided in the elastic band for receiving the diametrically opposed outwardly projecting pins carried by the neck of the conventional paint container. In another form, the receptacle extends circumferentially a distance greater than 180° and slots are formed in the inner wall of the receptacle for receiving the pins. In a still further form, the receptacle is formed integral with the paint container. A cap is also provided in the vent hole through the lid of the container to deflect paint leaking from or blown out of the container through the vent hole onto the outer face of the lid for collection in the receptacle. In another form, an annular receptacle is carried on the underside of the lid. An aperture is formed through its inner wall and lies in communication through the angular chamber defined thereby with a pair of vent holes opening through the lid thereby isolating such openings and precluding paint leakage through the vent.

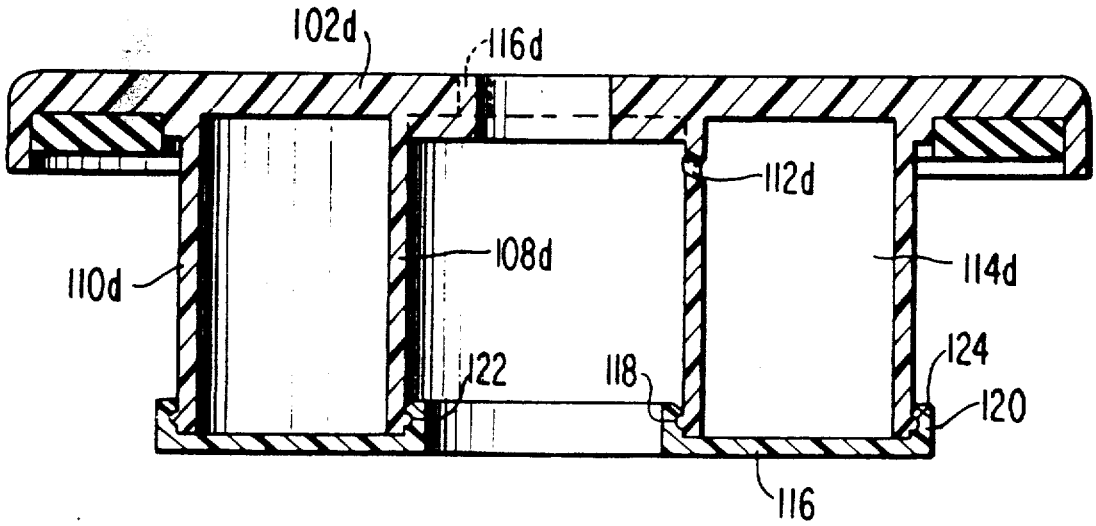

REEXAMINATION CERTIFICATE ISSUED UNDER 35 U.S.C. 307

THE PATENT IS HEREBY AMENDED AS INDICTED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 8, line 58 through column 9 line 10:

To close the bottom of annular chamber 114d, there is provided an annulus [116] *117* having upstanding inner and outer annular flanges 118 and 120 respectively. The inner margin of wall 108d is provided with a radially inwardly projecting bead 122, while the outer margin of outer wall 110d is provided with a radially outwardly projecting bead 124, beads 122 and 124 being located adjacent the lower ends of walls 108d and 110d respectively. Flanges 118 and 120 of annular member [116] *117* are provided with corresponding annular recesses about their respective outer and inner faces whereby the annular member [116] *117* can be releasably snapped onto walls 108d and 110d. Annulus [116] *117* thus forms a releasable closure for annular chamber 114d. In this manner, any paint entering chamber 114d can be readily removed by removing member [116] *117* from the walls 108d and 110d and cleaning the surface of member [116] *117* and/or the inner surfaces of the walls 108d and 110d. As in the previous embodiment, the vent passage is provided by openings 116*d*, chamber 114d, and aperture 112d.

The drawing figure has been changed as follows:

Reference numeral 116 changed to 117:

AS A RESULT OF REEXAMINATION, IT HAS BEEN DETERMINED THAT:

The patentability of claims 1–24 is confirmed.

* * * * *